US006089773A

United States Patent [19]

Bailey et al.

[11] Patent Number: 6,089,773

[45] Date of Patent: Jul. 18, 2000

[54] PRINT MEDIA FEED SYSTEM FOR AN INK JET PRINTER

[75] Inventors: Thomas Allen Bailey, Georgetown; David Michael Cseledy; Edmund Hulin James, III, both of Lexington, all of Ky.

[73] Assignee: Lexmark International, Inc., Lexington, Ky.

[21] Appl. No.: 08/990,143

[22] Filed: Dec. 12, 1997

[51] Int. Cl.[7] ..... B41J 13/10

[52] U.S. Cl. ..... 400/642; 400/645

[58] Field of Search ..... 400/636, 642, 400/636.3, 645, 645.3, 647.1

[56] References Cited

U.S. PATENT DOCUMENTS

| | | | |
|---|---|---|---|
| 4,422,782 | 12/1983 | Lawter et al. | 400/56 |
| 4,784,504 | 11/1988 | Hamano et al. | 400/605 |
| 5,011,314 | 4/1991 | Fujii | 400/619 |
| 5,098,211 | 3/1992 | Murakami et al. | 400/645 |
| 5,141,344 | 8/1992 | Murakami et al. | 400/579 |
| 5,161,905 | 11/1992 | Eriksson et al. | 400/637.1 |
| 5,170,183 | 12/1992 | Hirabayashi et al. | 346/134 |
| 5,183,333 | 2/1993 | Minowa | 400/605 |
| 5,193,800 | 3/1993 | Kashiwabara | 271/272 |
| 5,209,591 | 5/1993 | Mizutani et al. | 400/645 |
| 5,244,295 | 9/1993 | Terashima et al. | 400/639 |
| 5,343,229 | 8/1994 | Ohshima | 347/8 |
| 5,354,136 | 10/1994 | Takizawa et al. | 400/185 |
| 5,356,229 | 10/1994 | Hickman et al. | 400/642 |
| 5,365,261 | 11/1994 | Ozawa et al. | 347/103 |
| 5,366,301 | 11/1994 | Martin et al. | 400/56 |
| 5,373,312 | 12/1994 | Fujioka et al. | 347/102 |
| 5,409,530 | 4/1995 | Kanbayashi et al. | 106/27 A |
| 5,419,644 | 5/1995 | Martin et al. | 400/642 |
| 5,468,079 | 11/1995 | Murakoshi et al. | 400/521 |
| 5,489,160 | 2/1996 | Patrick et al. | 400/642 |
| 5,490,734 | 2/1996 | Maruyama et al. | 400/582 |
| 5,515,094 | 5/1996 | Tanaka et al. | 347/104 |
| 5,524,994 | 6/1996 | Hirano et al. | 400/579 |
| 5,530,466 | 6/1996 | Fujioka et al. | 347/104 |
| 5,564,847 | 10/1996 | Patrick et al. | 400/642 |
| 5,615,873 | 4/1997 | Kobayashi et al. | 271/121 |
| 5,623,296 | 4/1997 | Fujino et al. | 347/103 |
| 5,646,653 | 7/1997 | Fujioka et al. | 347/8 |
| 5,646,668 | 7/1997 | Fujioka et al. | 347/104 |
| 5,648,807 | 7/1997 | Saito et al. . | |
| 5,649,275 | 7/1997 | Kaneta | 399/381 |
| 5,650,807 | 7/1997 | Abe et al. | 347/43 |
| 5,669,724 | 9/1997 | Kato . | |

FOREIGN PATENT DOCUMENTS 2 290 753 1/1996 United Kingdom .

*Primary Examiner*—John S. Hilten
*Attorney, Agent, or Firm*—John A. Brady

[57] ABSTRACT

A print media feed system feeds a print medium in an advance direction through a print zone in an ink jet printer. A printhead includes a plurality of ink emitting nozzles and defines the print zone. A media control surface is positioned in association with the printhead. The media control surface is configured for engaging a back side of the print medium. A feed roller is positioned upstream from the print zone relative to the advance direction of the print medium. At least one deflector plate assembly is pivotable about an axis of rotation and includes at least one metering roller and at least one deflector plate. Each metering roller is positioned in association and defines a nip with the feed roller through which the print medium passes. Each deflector plate includes a deflector end which is disposed between each metering roller and the printhead. The deflector end is configured for deflecting the print medium. Each metering roller and the deflector end are movable toward and away from the feed roller upon rotation of the at least one deflector plate assembly about the axis of rotation.

19 Claims, 4 Drawing Sheets

Fig. 3
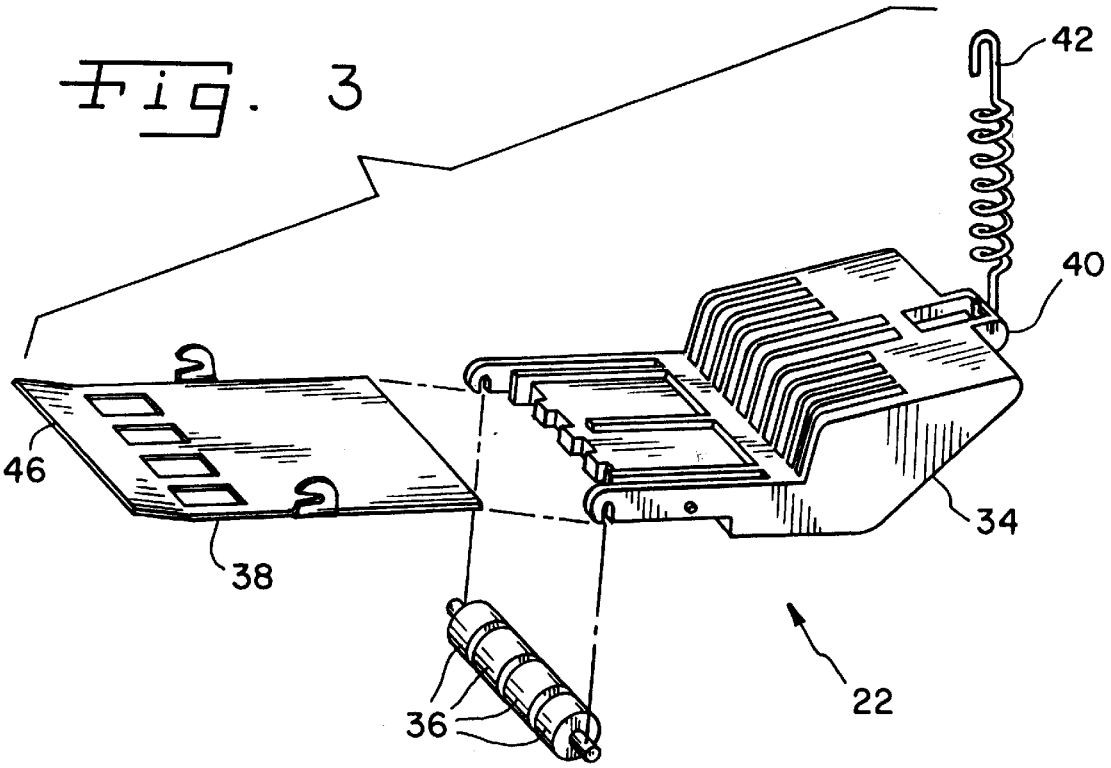
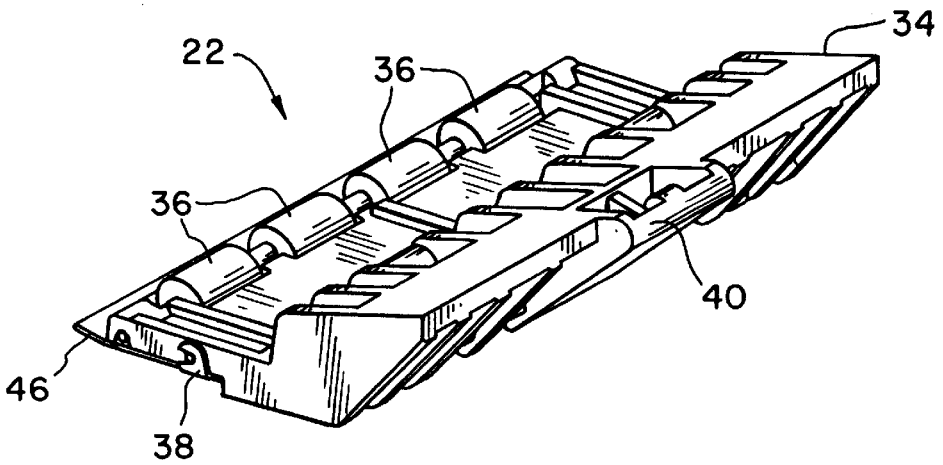
Fig. 4

PRINT MEDIA FEED SYSTEM FOR AN INK JET PRINTER

BACKGROUND OF THE INVENTION

1. Field of the Invention

The present invention relates to an ink jet printer, and, more particularly, to a print media feed system for an ink jet printer.

2. Description of the Related Art

An ink jet printer includes a paper or print media feed system which transports the print media, one sheet at a time, from a supply source such as a paper tray to a print zone where ink is jetted onto the print medium using an ink jetting printhead. The ink jetting printhead includes a plurality of ink jetting nozzles from which a selected color ink is jetted onto the print medium. Print quality can be improved if the print medium is allowed to be as close as possible to the print nozzles of the printhead. The clearance distance between the front side of the print medium and the print nozzles of the printhead is important because all ink jetting printheads exhibit a certain amount of satellites (smaller stray drops of ink) that are ejected slightly off trajectory from the main drop. If the clearance distance between the front side of the print medium and the ink jetting nozzles is small, the stray drops will be minimized.

However, the clearance distance between the ink jetting nozzles and the front side of the print medium can only be minimized to a certain extent. If the clearance distance is too small, cockle (waviness) in the print medium caused by wet ink may cause the front side of the print medium to touch the printhead in the area of the ink jetting nozzles. When the print medium is touching the printhead, the ink drops of course cannot be properly jetted onto the front side thereof for formation of a print image.

Conventional systems which control the clearance distance between the print medium and the printhead are of two basic types. The first type uses a back side control surface which is disposed at a predetermined distance away from the printhead. The print media is forced against the back side control surface. The distance between the front side of the print medium and the printhead thus varies dependent upon the thickness of the print medium. Since the back side control surface is fixed, the clearance distance between the front side of the print medium and the printhead must be sufficiently large such that the print medium will not contact the printhead in the event that cockling of the print medium occurs. Decreasing the clearance distance to improve print quality may result in the print medium contacting the printhead, which is not desirable as described above.

The second general type of system used to control the clearance distance between the print media and the printhead biases the print media against a front side control surface, as opposed to a back side control surface. The front side control surface may either be movable in transverse directions along with the printhead, or fixed and extend across the width of the print media. In either event, the clearance distance between the edge of the front side control surface and the print media is fixed and does not change, regardless of the type of print media used during printing.

For example, U.S. Pat. No. 5,648,807 (Saito, et al.) disclose an ink jet printer (FIG. 3A) having a paper feed roller 330 which is engaged by a pinch roller 350. Pinch roller 350 is rotatably attached to the distal end of a paper guide 53 which is suspended from a rear, fixed frame 130 using a spring 52 so that paper guide 53 rotates about a fulcrum point 51. Frame 130 not only interconnects with paper guide 53 as shown in FIG. 3A, but also substantially forms an enclosure which carries the plurality of gears, rollers, etc. (FIG. 18). As shown in FIG. 27, a lower end of rear frame 130 is attached to and carries a pressing member 140 which is disposed above feed roller 330. Because of the fixed nature of frame 130, pressing member 140 is always "located at a slightly lower position from a tangent T to both feed roller 330 and transport roller 381, and is arranged to press paper P downward." Because of the fixed and immovable nature of frame 130 and pressing member 140, pressing member 140 does not move with or relative to pinch roller 350 carried by paper guide 53, but rather is fixed in a stationary position.

What is needed in the art is a print media feed system which overcomes the problems associated with a fixed front side media control surface and a fixed back side media control surface.

SUMMARY OF THE INVENTION

The present invention provides a print media feed system which engages and biases the front side of a thin print medium to a first clearance distance from the printhead, and engages and biases the front side of a thicker or stiffer print medium to a second clearance distance from the printhead, with the second clearance distance being smaller than the first clearance distance.

The invention comprises, in one form thereof, a print media feed system for feeding a print medium in an advance direction through a print zone in an ink jet printer. A printhead includes a plurality of ink emitting nozzles and defines the print zone. A media control surface is positioned in association with the printhead. The media control surface is configured for engaging a back side of the print medium. A feed roller is positioned upstream from the print zone relative to the advance direction of the print medium. At least one deflector plate assembly is pivotable about an axis of rotation and includes at least one metering roller and at least one deflector plate. Each metering roller is positioned in association and defines a nip with the feed roller through which the print medium passes. Each deflector plate includes a deflector end which is disposed between each metering roller and the printhead. The deflector end is configured for deflecting the print medium. Each metering roller and the deflector end are movable toward and away from the feed roller upon rotation of the at least one deflector plate assembly about the axis of rotation.

An advantage of the present invention is that thinner print media which may exhibit cockling are disposed a further distance away from the printhead to inhibit contact with the printhead upon occurrence of cockling, and thicker print media not prone to cockling are disposed a closer distance to the printhead.

Another advantage is that the thinner and thicker print media are engaged and biased from the front side adjacent the print head to different clearance distances with the printhead, rather than being merely engaged from a fixed back side media control surface.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 3 is an exploded, perspective view of the deflector plate assembly of FIGS. 1 and 2;

FIG. 4 is an assembled, perspective view of the deflector plate assembly of FIGS. 13.

Corresponding reference characters indicate corresponding parts throughout the several views. The exemplification set out herein illustrate one preferred embodiment of the invention, in one form, and such exemplification is not to be construed as limiting the scope of the invention in any manner.

DETAILED DESCRIPTION OF THE INVENTION

Figure 1:
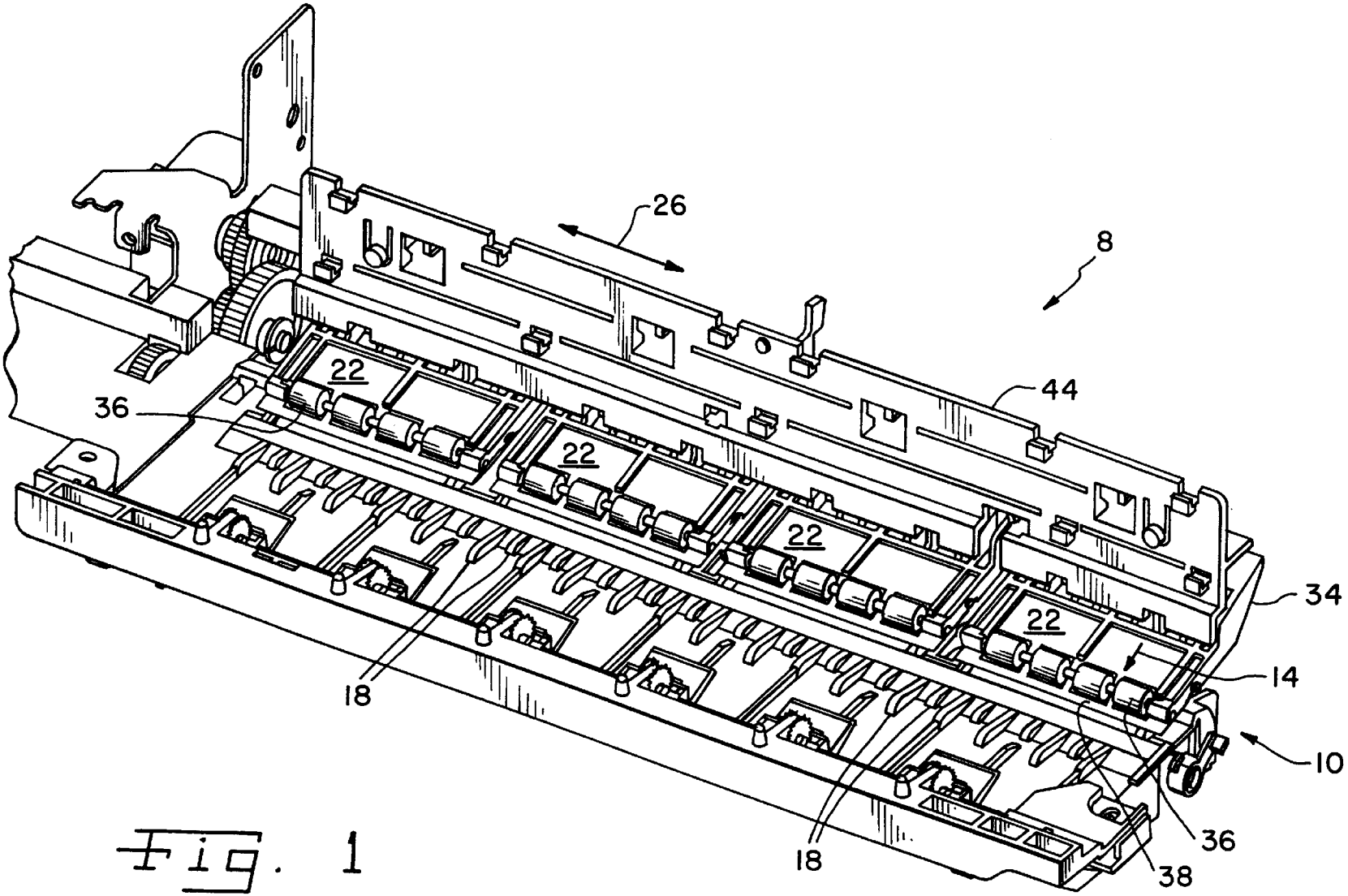
FIG. 1 is perspective view of a portion of a print media feed system of the present invention, with the carriage assembly and printhead not being shown for purposes of clarity.
Figure 2:
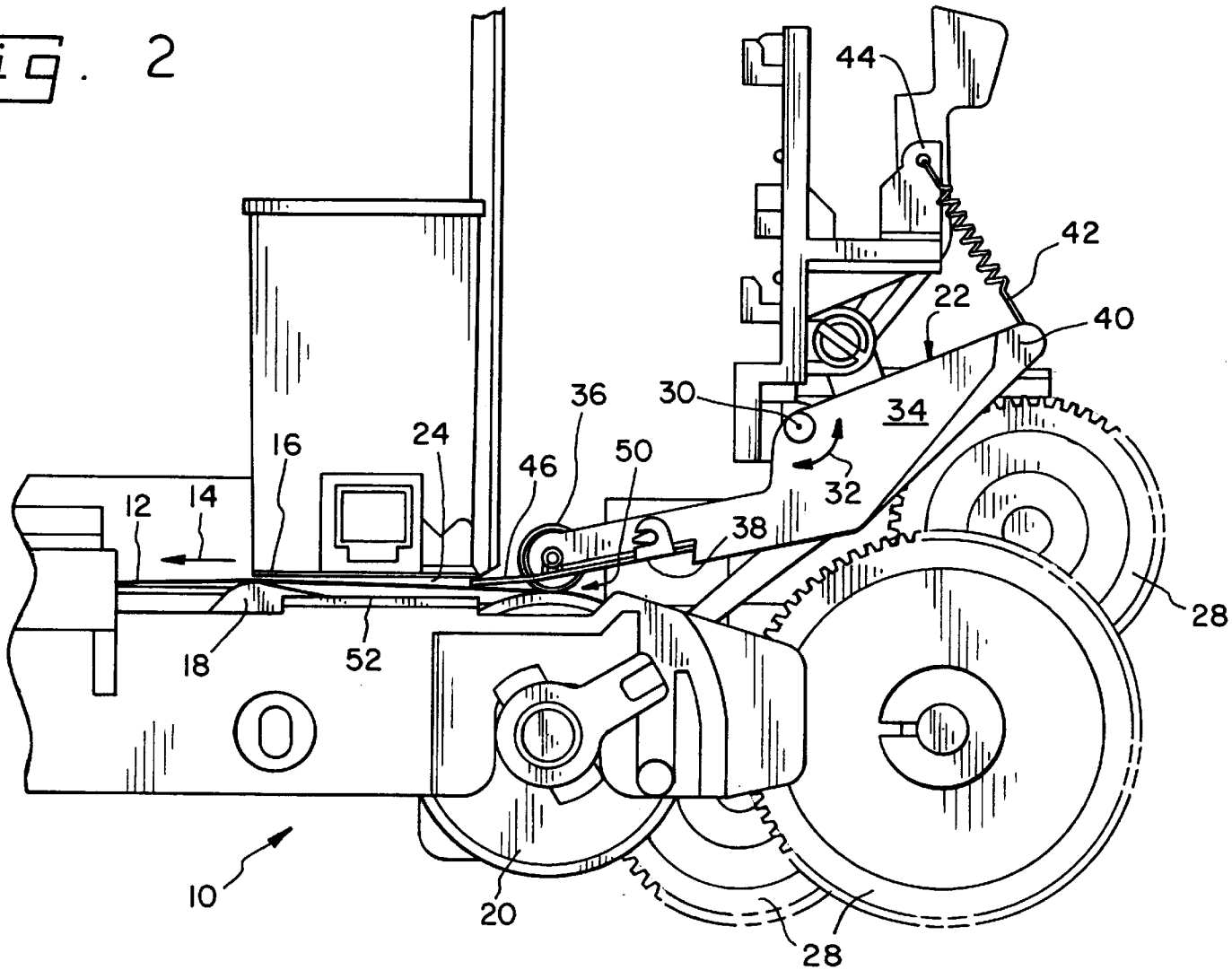
FIG. 2 is a side view of the print media feed system of FIG. 1, including the printhead.

Referring now to the drawings, and more particularly to FIGS. 1 and 2, there is shown an ink jet printer 8 including an embodiment of a print media feed system 10 for feeding a print medium 12 in an advance direction 14 through a print zone where ink is jetted onto print medium 12. The print media feed system generally includes an ink jetting printhead 16, a media control surface 18, a feed roller 20 and at least one deflector plate assembly 22.

Ink jetting printhead 16 (FIG. 2) includes a plurality of ink emitting nozzles (not shown) through which an ink of a selected color is jetted onto print medium 12. In the embodiment shown, printhead 16 is moved in opposite transverse directions 26 back and forth across an image area on print medium 12 as print medium 12 moves in advance direction 14 through a print zone 24 defined by printhead 16. Print zone 24 is defined as the area adjacent to the ink emitting nozzles in printhead 16 where the ink is jetted onto print medium 12. Although printhead 16 is shown as a movable printhead which may be scanned in transverse directions 26, it is also to be understood that the printhead may be configured as a page-wide printhead extending across the width of print medium 12. Since printhead 16 is of conventional design, only a portion thereof is shown in FIG. 2 for purposes of simplicity. Moreover, printhead 16 and the associated movable carriage assembly which carry printhead 16 are not shown in FIG. 1 for purposes of clarity so that deflector plate assemblies 22 may be more easily seen.

Media control surface 18 is positioned in association with printhead 16, and is configured for engaging a back side of print medium 12. The back side of print medium 12 is defined herein as the side of print medium 12 opposite printhead 16, and the front side of print medium 12 is defined herein as the side adjacent to printhead 16. In the embodiment shown, media control surface 18 is configured as a plurality of cockle control ribs 18 which are successively arranged across the width of print medium 12. Cockle control ribs 18 are positioned downstream from print zone 24 relative to advance direction 14 of print medium 12. Cockle control ribs 18 have a width across the land thereof and are spaced apart relative to each other to control the frequency of cockling (or buckling) of print medium 12 if print medium 12 is prone to cockling during printing of a relatively dense image thereon (i.e., a substantial amount of ink is jetted onto print medium 12).

Feed roller 20 is one of a plurality of rollers in the paper feed path of ink jet printer 8 which carry print medium 12 to print zone 24. The rollers, including feed roller 20, are driven by a plurality of gears 28 which are in turn driven by a source of rotational power, such as an electric motor (not shown). In the embodiment shown, feed roller 20 is rotationally driven and feeds print medium 12 into print zone 24. However, it may not be necessary to rotationally drive feed roller 20 for a certain application. That is, feed roller 20 may be a non-driven roller which rotates as a result of engagement with print medium 12. However, feed roller 20 is preferably in the form of a driven feed roller which is positioned immediately upstream from print zone 24 relative to advance direction 14 of print medium 12.

Four deflector plate assemblies 22 (FIGS. 1–4) are successively arranged across the width of print medium 12 on the upstream side of print zone 24 relative to advance direction 14 of print medium 12. Although four deflector plate assemblies 22 are shown in FIGS. 1 and 2, a different number of deflector plate assemblies 22 may be utilized within ink jet printer 8. Each deflector plate assembly plate 22 includes an elongate base 34, at least one metering roller 36 and at least one deflector plate 38. Elongate base 34 is rotatable about axis of rotation 30, as indicated by arrow 32. Elongate base 34 includes an extension 40 with a portion thereof which is attached with a tension spring 42, which in turn is attached at the other end thereof to frame 44. Tension spring 42 biases elongate base 34, metering rollers 36 and deflector plate 38 toward feed roller 20 as a result of the torsional force applied to elongate base 34 about axis of rotation 30.

Although deflector plate assemblies 22 are shown as being rotationally biased about axis of rotation 30 using respective tension springs 42, it will be appreciated that other types of tensioning devices, such as leaf springs, coil springs, etc. may also be used. Likewise, the physical properties of the tensioning device, such as the spring constant, may be varied based upon empirical testing. Moreover, if each deflector plate assembly 22 rotates about a horizontal axis and the leverage around the axis of rotation at metering roller 36 and deflector end 46 is of sufficient magnitude, an additional tensioning device such as a tension spring 42 may not be required.

A single deflector plate 38 is connected to and extends from each elongate base 34. However, deflector plate 38 may be provided in multiple segments or pieces, if desired. Each deflector plate 38 includes a deflector end 46 which is disposed between each of metering rollers 36 and printhead 16. Deflector end 46 is configured for deflecting print medium 12 at a location immediately upstream from print zone 24, relative to advance direction 14 of print medium 12. Deflector end 46 deflects print medium 12 in a direction away from printhead 16, as will be described in further detail hereinafter.

Each deflector plate assembly 22 includes four metering rollers 36, although a different number of metering rollers 36 may be utilized. Metering rollers 36 have substantially the same diameter, and are rotationally carried by elongate base 34 along a common axis of rotation 30, as indicated by directional arrow 32 in FIG. 2. Each metering roller 36 is positioned in association and defines a nip 50 with feed roller 20 through which print medium 12 passes. When a print medium 12 is not disposed within nip 50, each metering roller 36 is disposed in engagement with feed roller 20.

Figure 5:
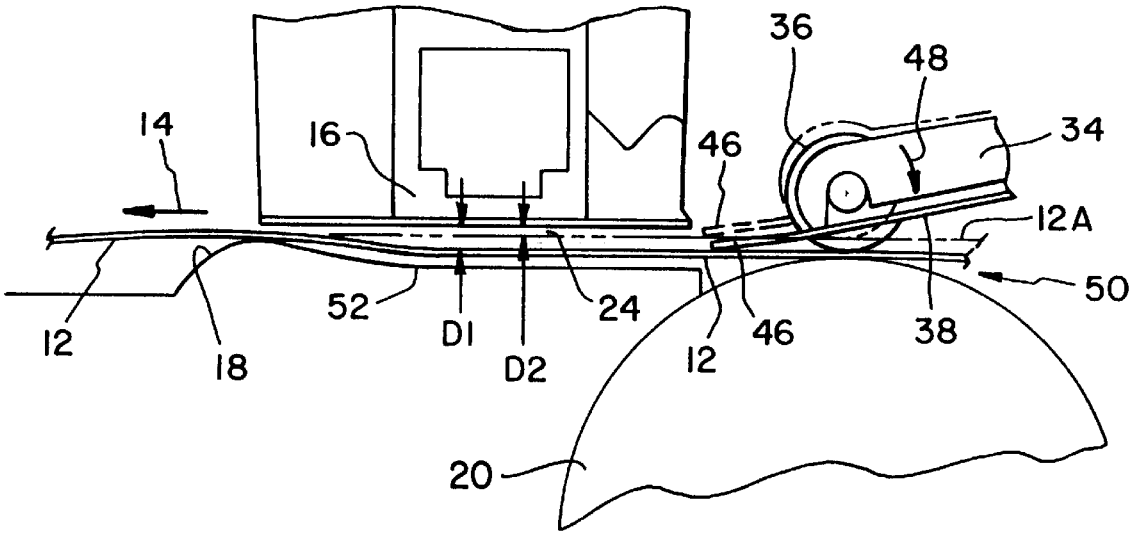
FIG. 5 is a simplified, schematic illustration of the deflector plate assembly of FIGS. 1–4 when alternately engaged with a thinner print medium and a thick print medium.

FIG. 5 illustrates use of the deflector plate assembly 22 of the present invention with a thinner print medium 12 (shown in solid lines) and a thicker and/or stiffer print medium 12A (shown in dashed lines). Print medium 12 is engaged by feed roller 20 and is carried though nip 50 formed with metering rollers 36. Metering rollers 36 and deflector end 46 of deflector plate 38 are moved away from feed roller 20 a gap distance (not numbered) which is associated with the thickness of print medium 12. Depending upon the force applied by tension spring 42, metering rollers 36 may slightly compress print medium 12 such that the gap distance is slightly less than the thickness of print medium 12. Likewise, the compressive force applied to print medium 12 in nip 50 by metering rollers 36 may result in a slight cupping of feed roller 20, depending upon the material from which feed roller 20 is constructed. Deflector end 46 of deflector plate 38 is positioned slightly below nip 50. More particularly, print medium 12 may tend to be angled slightly upward toward printhead 16 when exiting from nip 50. By positioning deflector plate 38 at a slightly downward angle and terminating deflector end 46 at a position which is slightly below nip 50, print medium 12 is again biased in a downward direction leading into print zone 24. Thus, for a thinner print medium such as print medium 12 shown in FIG. 5, deflector end 46 maintains the front side of print medium 12 at a first clearance distance D1 relative to printhead 16 which is sufficient to inhibit print medium 12 from contacting printhead 16 in the event that cockling would occur during printing of a dense print image.

As print medium 12 passes through print zone 24, it may be readily seen that print medium 12 does not contact a back side surface 52 opposite printhead 16. Rather, print medium 12 is suspended within print zone 24 and is carried at the back side thereof by feed roller 20 and cockle control ribs 18 disposed on either side of print zone 24. Back side surface 52 may be thought of as a gutter or trough which diverts ink which may be inadvertently jetted from printhead 16 in the absence of a print medium 12 within print zone 24.

A thicker print medium 12A such as cardstock or the like may also be transported through nip 50 and print zone 24. As shown by the dashed lines in FIG. 5, the thicker print medium 12A causes metering rollers 36 to be disposed at a larger gap distance from feed roller 20 which is associated with the thickness of print medium 12A. Movement of metering roller 36 away from feed roller 20 causes slight rotational movement of elongate base 34 and deflector plate 38 about axis of rotation 30, which in turn results in a vertically upwards translational displacement of deflector end 46. Deflector end 46 thus does not deflect thicker print medium 12A as much as the deflection of thinner print medium 12. As a result, thicker print medium 12A travels in more of a straight line path from nip 50 to cockle control ribs 18, and is allowed to be disposed at a smaller clearance distance D2 from printhead 16. Since the thicker and/or stiffer print medium 12A is not as inclined to cockling when compared with thinner print medium 12, the front side of print medium 12A may be disposed at the smaller clearance distance D2 relative to printhead 16 without the concern of cockling causing contact between the front side of thicker print medium 12A and printhead 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A print media feed system for feeding a print medium in an advance direction through a print zone in an ink jet printer, said print media feed system comprising:

an ink jetting printhead defining the print zone;

a media control surface positioned in association with said printhead, said media control surface being configured for engaging a back side of the print medium;

a feed roller positioned upstream from the print zone relative to the advance direction of the print medium; and at least one deflector plate assembly pivotable about an axis of rotation and including at least one metering roller and at least one deflector plate, each said metering roller being positioned in association and defining a nip with said feed roller through which the print medium passes, each said deflector plate including a deflector end which is disposed between each said metering roller and said printhead, each said deflector end being configured for deflecting the print medium, each said metering roller and each said deflector end being movable toward and away from said feed roller upon rotation of said at least one deflector plate assembly about said axis of rotation.

2. The print media feed system of claim 1, wherein said at least one deflector plate assembly comprises a plurality of deflector plate assemblies.

3. The print media feed system of claim 2, wherein said plurality of deflector plate assemblies comprise four deflector plate assemblies.

4. The print media feed system of claim 1, wherein each said deflector plate assembly further comprises an elongate base which is rotatable about said axis of rotation, each said deflector plate being connected to and extending from said elongate base.

5. The print media feed system of claim 1, wherein each said deflector plate assembly includes a means for biasing each said metering roller and said deflector end toward said feed roller.

6. The print media feed system of claim 5, wherein said biasing means comprises a spring.

7. The print media feed system of claim 6, wherein said spring comprises a tension spring.

8. The print media feed system of claim 1, wherein said at least one deflector plate comprises one deflector plate.

9. The print media feed system of claim 1, wherein each said deflector end is configured for deflecting the print medium in a direction away from said printhead.

10. The print media feed system of claim 1, wherein each of said metering rollers and said feed roller engage the print medium when the print medium passes through said nip.

11. The print media feed system of claim 1, wherein each said metering roller and each said deflector end is movable away from said feed roller a gap distance which is associated with a thickness of the print medium when the print medium passes through said nip.

12. The print media feed system of claim 11, wherein said gap distance is less than the thickness of the print medium.

13. The print media feed system of claim 1, wherein each said metering roller is positioned in engagement with said feed roller when the print medium is not in said nip.

14. The print media feed system of claim 1, wherein said media control surface comprises a plurality of cockle control ribs.

15. The print media feed system of claim 14, wherein said plurality of cockle control ribs are positioned substantially downstream from said print zone relative to the advance direction of the print medium.

16. The print media feed system of claim 1, wherein said printhead is movable in directions transverse to the advance direction of the print medium.

17. The print media feed system of claim 1, wherein said feed roller comprises a driven feed roller.

18. A print media feed system for feeding a first type and a second type of print media in an advance direction through a print zone in an ink jet printer, the first type and second type of print media each having a front side to be printed on in the print zone, the first type of print media having a thickness which is less than the second type of print media, said print media feed system comprising:

an ink jetting printhead defining the print zone;

a media control surface positioned in association with said printhead, said media control surface being configured for engaging a back side of the print medium; and means for engaging and biasing the front side of the first type of print media to a first clearance distance from said printhead, and engaging and biasing the front side of the second type of print media to a second clearance distance from said printhead, said second clearance distance being smaller than said first clearance distance.

19. The print media feed system of claim 18, further comprising a feed roller positioned upstream from the print zone relative to the advance direction of the print medium; and wherein said engaging and biasing means comprises at least one deflector plate assembly pivotable about an axis of rotation and including at least one metering roller and at least one deflector plate, each said metering roller being positioned in association and defining a nip with said feed roller through which the print medium passes, each said deflector plate including a deflector end which is disposed between each said metering roller and said printhead, each said deflector end being configured for deflecting the print medium, each said metering roller and each said deflector end being movable toward and away from said feed roller upon rotation of said at least one deflector plate assembly about said axis of rotation.

* * * * *